United States Patent [19]

Hastings

[11] 4,335,419

[45] Jun. 15, 1982

[54] INSULATED DUST CONTROL APPARATUS FOR USE IN AN EXPLOSIVE ENVIRONMENT

[76] Inventor: Edward E. Hastings, 28 Wistar Rd., Villanova, Pa. 19085

[21] Appl. No.: 198,739

[22] Filed: Oct. 20, 1980

[51] Int. Cl.[3] ..... B05B 5/02

[52] U.S. Cl. ..... 361/228; 239/691

[58] Field of Search ..... 361/215, 226, 227, 228; 239/690, 691, 706

[56] References Cited

U.S. PATENT DOCUMENTS

| | | | |
|---|---|---|---|
| 2,302,185 | 11/1942 | Campbell | 239/707 |
| 3,698,635 | 10/1972 | Sickles | 239/3 |
| 4,004,733 | 1/1977 | Law | 239/3 |
| 4,009,829 | 3/1977 | Sickles | 239/15 |
| 4,120,017 | 10/1978 | Sickles | 361/228 |
| 4,186,886 | 2/1980 | Sickles | 239/691 |
| 4,190,875 | 2/1980 | Smart et al. | 361/228 |
| 4,219,864 | 8/1980 | Grunenfelder et al. | 361/228 |

*Primary Examiner*—L. C. Schroeder

*Attorney, Agent, or Firm*—Seidel, Gonda, Goldhammer & Panitch

[57] ABSTRACT

An apparatus is provided for producing a spray of atomized and electrostatically charged particles of liquid to remove oppositely charged pollutants from the atmosphere. The apparatus is particularly suited for use in a potentially explosive atmosphere. The apparatus includes a nozzle which receives liquid and compressed air and produces a high pressure spray of atomized liquid particles. A ring electrode coaxially surrounds the spray near the nozzle. The electrode is chargeable to a high electrostatic potential relative to the nozzle, whereby the liquid particles of the spray are inductively charged by passing the ring. The electrode is fully encased in a ring of insulating material. A grounded metal housing surrounds the ring of insulating material on all sides except the radially interior side thereof. The metal housing and ring of insulating material are coated on all exposed surfaces by a dip coating of insulating material.

15 Claims, 3 Drawing Figures

INSULATED DUST CONTROL APPARATUS FOR USE IN AN EXPLOSIVE ENVIRONMENT

BACKGROUND OF THE INVENTION

It is a known practice to use an atomized spray of electrostatically charged liquid to remove dust or similar fine pollutant particles from an atmosphere. These devices operate on the principle that the pollution particles remain suspended in the atmosphere in part because they carry an electrostatic charge. The liquid spray is inductively charged with a polarity opposite that of the pollution particles, with the result that the particles are attracted to the spray droplets and are thereby precipitated out of the atmosphere. Representative devices of this type may be seen by reference to at least U.S. Pat. Nos. 3,729,898 and 4,190,875, and the background discussions contained therein.

In typical devices of this type, a metallic ring electrode is positioned in a coaxial relationship around the tip of a spray nozzle. A suitable liquid, usually water, is discharged from the nozzle in the form of a high pressure atomized spray. As the spray passes the ring electrode, the atomized water particles are given a small electrostatic charge opposite in polarity to that of the ring electrode.

However, because of the high electrical potential required between the electrode and the nozzle, devices of this type present a shock hazard for humans. An even greater hazard arises if the device is employed in a potentially explosive environment, such as methane gas or vaporization fumes of highly flammable liquids. A single discharge arc between the ring electrode and the nozzle or surrounding structure could immediately ignite these materials. For the above reasons, devices of this type have not been widely used in potentially explosive environments, such a coal mines, even though the use of charged water sprays is known to be very effective in controlling coal dust.

In recognition of the extreme hazard presented by electrical arcing in a coal mine environment, a federal safety code for electrical equipment in coal mines has been developed under the authority of the United States Mine Safety and Health Administration. One of the mandatory design criteria for this equipment is that the high voltage areas of the equipment be shielded by a grounded metal housing. This requirement presents an obstacle to the use of inductively charged spray devices, since the ring electrode will not charge the spray particles if the electrode is encased in a grounded housing.

Accordingly, it is an object of the present invention to provide an inductively charged spray device with effective safeguards against electrical arcing so that the device may be used in a potentially explosive atmosphere. In addition, it is a further objective to provide such a device wherein the electrode is shielded by a grounded metal housing in compliance with the applicable federal mine safety codes.

SUMMARY OF THE INVENTION

An apparatus is provided for producing a spray of atomized and electrostatically charged particles of liquid to remove oppositely charged pollutants from the atmosphere. The apparatus is particularly suited for use in a potentially explosive atmosphere. The apparatus includes a nozzle which receives liquid and compressed air and produces a high pressure spray of atomized liquid particles. A ring electrode coaxially surrounds the spray near the nozzle. The electrode is chargeable to a high electrostatic potential relative to the nozzle, whereby the liquid particles of the spray are inductively charged by passing the ring. The electrode is fully encased in a ring of insulating material. A grounded metal housing surrounds the ring of insulating material on all sides except the radially interior side thereof. The metal housing and ring of insulating material are coated on all exposed surfaces by a dip coating of insulating material.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE SPECIFICATION

Figure 1:
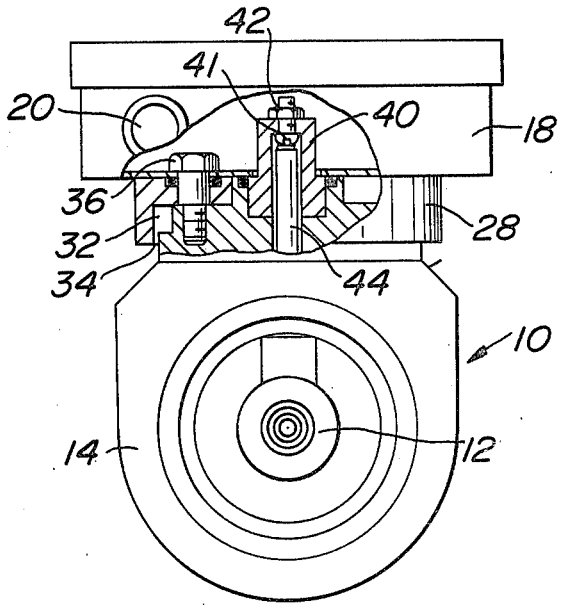
FIG. 1 is a front view of the apparatus having structural cut-away in part to show internal features.
Figure 2:
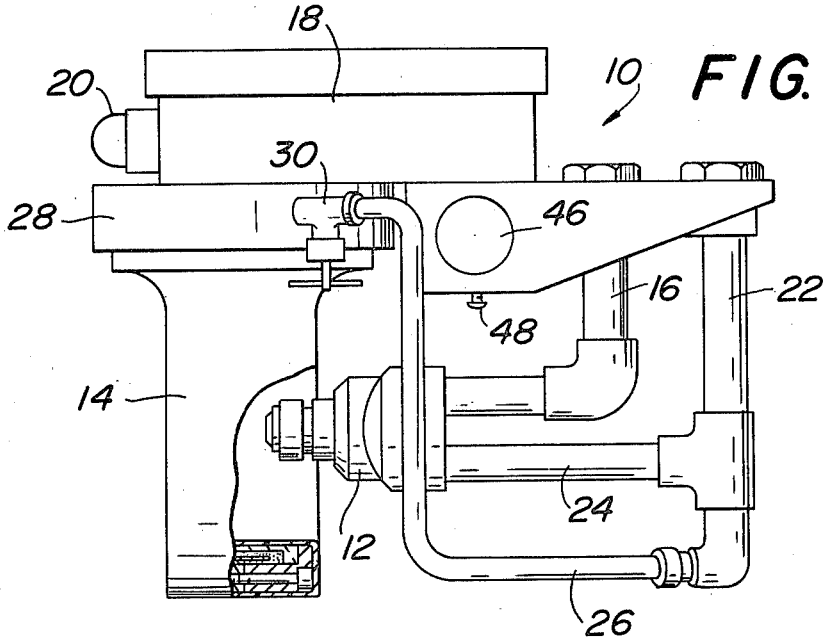
FIG. 2 is a side view of the apparatus having part of the structure cut-away to reveal internal features.

Referring now to the drawings, wherein like numerals indicate like elements, there is shown in FIGS. 1 and 2 an apparatus according to the present invention designated generally as 10. Apparatus 10 is a device for producing a spray of atomized and electrically charged liquid particles to remove oppositely charged pollutants from the atmosphere. This atomized spray is produced by a nozzle 12, aligned coaxially with charging collar 14.

Nozzle 12 receives liquid under pressure through line 16 from a liquid supply source (not shown). The liquid will most commonly be water for general applications, although it is possible that specialized applications will require other liquids. Nozzle 12 may be any of a variety of known atomizing nozzles. In the nozzle 12 depicted, water and air are discharged together through one or more fine orifices to produce an atomized spray. Nozzle 12 is coaxially aligned with charging collar 14, with the spray end of nozzle 12 extending slightly inside coller 14. The charging effect of collar 14 is increased by surrounding the spray just as it exits from nozzle 12. Nozzle 12 is grounded (zero potential).

Charging collar 14 utilizes an extremely high voltage potential from voltage source 18 to create an electrostatic field for inductively charging the particles of spray. Voltage source 18 supplies about 10,000 volts d.c. to collar 14 to create the electrostatic field. The polarity selected depends on the pollutant, and should be the same as the charge on the pollutant, since the water will be inductively charged opposite to the polarity of the collar 14. Source 18 may be a transformer rectifier, d.c. generator or other device capable of supplying a d.c. voltage of this magnitude. A lamp 20 is attached to the housing of voltage source 18, and utilizes a reduced voltage to illuminate when the device is in operation, indicating that the device is receiving power.

High pressure compressed air is introduced through line 22. Line 22 is divided into two further lines, 24 and 26. Line 24 introduces dry high pressure air to nozzle 12 for producing a jet spray of atomized liquid particles. Air through line 26 is introduced to purging collar 28 through a needle valve 30. Purging collar 28 is a circular collar located between charging collar 14 and voltage source 18. The purpose of purging collar 28 is to direct dry high pressure air along charging collar 14 to prevent build-up of a liquid film which might create a conductive path between collar 14 and voltage source 18.

Referring now to FIG. 1, the cut-away portion of charging collar 28 reveals a manifold 32 into which high pressure air is introduced when needle valve 30 is open. Manifold 32 distributes air around purging collar 28. There is a small air slot 34 between purging collar 28 and the upper structure of charging collar 14. Thus, the dry high pressure air is discharged through slot 34 along the sides of charging collar 14 and pushes any water droplets that have accumulated on collar 14 away from voltage source 18.

Shoulder bolts 36 (only one is visible) attach voltage source 18 and purging collar 28 to charging collar 14. An insulator sleeve 40 extends upward inside of voltage source 18. A screw 41 and nut 42 contact at the top of sleeve 40 receives high voltage d.c. current through a connecting wire (not shown). A high value resistance 44 (approximately 500 M ohms) is spring biased to contact the head of screw 41, and at its other end contacts the ring electrode described below. Resistor 44 provides a current limiting resistance to reduce the shock hazard of the device. This is an intrinsic safety feature which operates as a back-up to the insulating features to be described below.

A mounting bore 46 is provided in apparatus 10 to accommodate a mounting bar (not shown) to hold the spray directed at the desired area. A friction screw 48 extends into mounting bore 46 to contact the mounting bar and secure the device 10 in the proper position.

Figure 3:
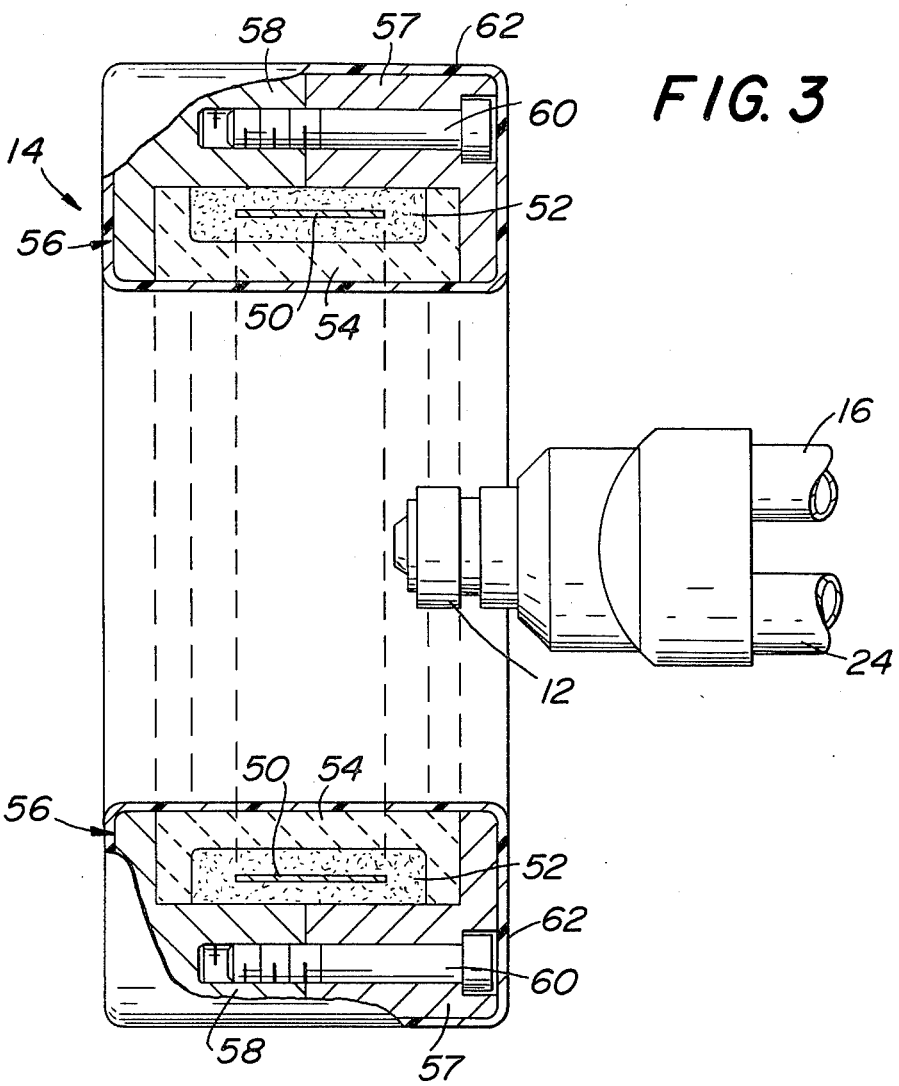
FIG. 3 is a close-up side view of the nozzle and charging collar portion of the apparatus, having part of the charging collar structure cut-away to reveal internal features.

Referring now to FIG. 3, the details of charging collar 14 may be observed. Resistor 44 is spring biased into contact with a brass ring electrode 50. Ring electrode 50 distributes the high voltage from source 18 over its entire circumference, thus creating an electrostatic field for inductively charging the liquid spray. Electrode 50 is encased in a ring 52 of epoxy potting which provides insulation of the entire electrode 50. Epoxy ring 52 is seated in an annular channel in the radially outside surface of another ring 54, which may be made of glass or ceramic. The glass or ceramic ring 54 provides a field "window" for the electrostatic field produced by electrode 50.

To meet the design criteria of certain mine safety codes, ring 54 is surrounded by a metal housing 56 formed by half-rings 57 and 58 secured together by cap screws 60. Half rings 57 and 58 surround ring 54 on all exterior sides except the radially interior side, or field "window". The metal housing 56 is connected to ground potential (or the same potential as nozzle 12, if it is other than ground). Thus, all external surfaces of charging collar 14 are shielded by a grounded metal housing in compliance with the relevant design criteria of the mine safety codes.

The entire charging collar 14 is dip-coated in an epoxy solution, such as plastisol, to produce a film 62 of insulation around the entire collar. This insulating film 62 is necessary, in that water from the spray may accumulate on the surface of ring 54 and form a conductive path to the grounded metal housing 56. The accumulated water would then function as a shield to the electrostatic field. The film 62 insulates the metal housing from accumulated water, thus maintaining a strong electrostatic field. Purging collar 28, as described above, prevents accumulated water from becoming electrically grounded through contact with other structure.

Thus, it may be seen that the major objectives of the present invention have been accomplished. The risks of shock hazard and electrical arcing have been minimized by completely insulating the field electrode 50 from the water spray. The current limiting resistor 46 provides a back-up intrinsic safety limitation. In addition, the design criteria mandated by the federal mine safety codes has been met by providing a grounded metal housing 56 for the ring electrode. Housing 56 has been constructed and insulated so that it can meet the mine safety design requirements without interfering with the inductive charging effect of the electrode 50 on the water spray.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for producing a spray of atomized and electrostatically charged particles of liquid to remove oppositely charged pollutants from an atmosphere, said apparatus being particularly suited for use in a potentially explosive atmosphere, comprising:

(a) a nozzle for receiving the liquid from a liquid supply and producing a spray of atomized liquid particles;

(b) a ring electrode coaxially surrounding the spray near the nozzle, the ring being chargeable to a high electrostatic potential relative to the nozzle whereby the liquid particles of the spray are inductively charged by passing through the ring, the electrode being fully encased in a ring of insulating material whereby liquid particles cannot contact the electrode;

(c) a metal housing surrounding the ring of insulating material on all sides except the radially interior side thereof, the housing being connected to ground potential; and (d) a coating of insulating material covering the exposed surfaces of the metal housing and the ring of insulating material.

2. Apparatus as in claim 1 further comprising the ring of insulating material being seated in an annular channel on the radially outside surface of a ceramic ring, and the metal housing surrounding the ceramic ring on all sides except the radially interior side thereof.

3. Apparatus as in claim 1 further comprising the ring of insulating material being seated in an annular channel in the radially outside surface of a glass ring, and the metal housing surrounding the glass ring on all sides except the radially interior side thereof.

4. Apparatus as in claim 1 wherein the coating of insulating material is produced by dip-coating the metal housing and ring of insulating material after assembly with an insulating material.

5. Apparatus as in claim 1 further comprising a source of high voltage direct current positioned adjacent the housing and electrically connected through a high resistance to charge the ring electrode to a high electrostatic potential, and means for producing a flow of high velocity dry air between the source and the housing to prevent accumulated water from forming a conductive path between the voltage source and any surrounding grounded portion of the apparatus.

6. Apparatus for removing dust particles from an atmosphere, comprising:

(a) an electrically grounded spray nozzle for producing a high velocity spray of atomized liquid particles;

(b) a ring electrode coaxially aligned around a discharge port of the spray nozzle, said electrode being chargeable to a high electrical potential relative to the grounded nozzle, whereby an electrostatic field is produced for inductively charging the liquid particles passing through said field;

(c) an insulating and shielding collar assembly surrounding said electrode, the collar comprising a ring of insulating material completely surrounding the ring electrode, a grounded metallic housing surrounding the ring of insulating material on all sides except the radially interior side thereof, and a film of insulating material covering all exposed surfaces of the housing and insulating ring.

7. Apparatus as in claim 6 further comprising the ring of insulating material being seated in an annular channel in the radially outside surface of a ceramic ring, and the metal housing surrounding the ceramic ring on all sides except the radially interior side thereof.

8. Apparatus as in claim 7 wherein the film of insulating material is produced by dip-coating the metal housing and ceramic ring after assembly with an insulating material.

9. Apparatus as in claim 6 further comprising the ring of insulating material being seated in an annular channel in the radially outside surface of a glass ring, and the metal housing surrounding the glass ring on all sides except the radially interior side thereof.

10. Apparatus as in claim 9 wherein the film of insulating material is produced by dip-coating the metal housing and glass ring after assembly in a solution of insulating material.

11. In an apparatus for producing a spray of atomized and electrostatically charged liquid particles to remove oppositely charged pollutants from a hazardous atmosphere, the particles of the spray being inductively charged as the particles pass through an electrostatic field produced by a ring electrode coaxially surrounding the spray, the improvement comprising means for providing a grounded metal shield around the ring electrode without interfering with the electrostatic field from inductively charging the liquid particles, and for completely insulating said ring electrode and grounded metal shield from the liquid spray, whereby the risk of electrical arcing is reduced making the apparatus particularly suited for use in a potentially explosive atmosphere.

12. An apparatus as in claim 11 wherein the means for insulating the ring electrode and for providing a grounded metal shield comprises a collar assembly wherein the ring electrode is encased in a ring of insulating material, a grounded metallic housing surrounds the ring of insulating material on all sides except the radially interior side thereof, and a coating of insulating material covers all exposed surfaces of the metal housing and the ring of insulating material.

13. Apparatus as in claim 11 wherein the means for insulating the ring electrode and for producing a grounded metal shield comprises a collar assembly wherein the ring electrode is encased in a ring of insulating material, the ring of insulating material being seated in an annular channel in the radially outside surface of a ceramic ring, a grounded metal housing surrounding the ceramic ring on all sides except the radially interior side thereof, and a coating of insulating material covering all exposed surfaces of the metallic housing and the ceramic ring.

14. Apparatus as in claim 11 wherein the means for insulating the ring electrode and for producing a grounded metal shield comprises a collar assembly wherein the ring electrode is encased in a ring of insulating material, the ring of insulating material being seated in an annular channel in the radially outside surface of a glass ring, a grounded metal housing surrounding the glass ring on all sides except the radially interior side thereof, and a coating of insulating material covering all exposed surfaces of the metallic housing and the glass ring.

15. Apparatus for removing dust particles from an atmosphere, comprising:

(a) an electrically grounded spray nozzle for producing a high velocity spray of atomized liquid particles;

(b) a ring electrode coaxially aligned around a discharge port of the spray nozzle, said electrode being chargeable to a high electrical potential relative to the grounded nozzle, whereby an electrostatic field is produced for inductively charging the liquid particles passing through said field;

(c) an insulated charging collar assembly surrounding said electrode, whereby the electrode is completely insulated from the spray;

(d) a source of high voltage direct current positioned adjacent the charging collar assembly and electrically connected to the ring electrode; and (e) a flow of high velocity dry air between the source and the charging collar assembly, by means comprising a purging collar located between said source and said charging collar, to prevent accumulated water from forming a conductive path between the voltage source and any surrounding grounded portion of the apparatus.

* * * * *